United States Patent [19]

Stribel

[11] Patent Number: 5,051,716

[45] Date of Patent: Sep. 24, 1991

[54] METHOD OF MANUFACTURING OF AN ELECTROMAGNETIC RELAY AND RELAY OBTAINED THEREBY

[75] Inventor: Hans P. Stribel, Nürtingen, Fed. Rep. of Germany

[73] Assignee: Stribel GmbH, Frickenhausen, Fed. Rep. of Germany

[21] Appl. No.: 453,868

[22] Filed: Dec. 20, 1989

[30] Foreign Application Priority Data

Dec. 20, 1988 [DE] Fed. Rep. of Germany ..... 3842815

[51] Int. Cl.[5] ..... H01F 3/00; H01F 7/08

[52] U.S. Cl. ..... 335/281; 29/606; 335/128

[58] Field of Search ..... 335/281, 128; 29/602.1, 29/606

[56] References Cited

U.S. PATENT DOCUMENTS 4,720,909 1/1988 Knight et al. ..... 29/606

4,749,977 6/1988 Prouty et al. ..... 335/281

FOREIGN PATENT DOCUMENTS 1543930 10/1968 France ..... 335/281

*Primary Examiner*—Harold Broome

*Attorney, Agent, or Firm*—Michael J. Striker

[57] ABSTRACT

The electromagnetic relay, particularly an armature relay, includes a ferromagnetic yoke with a yoke wall, and a ferromagnetic coil core, which is mounted by inserting a neck portion thereof in a hole in the yoke wall, for example in a press fit. To provide a connection between the coil core and the yoke which is more permanent, a support for the coil core is provided on the yoke wall which includes a projection on the inner surface of the yoke wall and a recess in an outer surface of the yoke wall (4) on an opposing side from the projection on the inner surface (27). The projection (28) extends from the inner surface of the yoke wall toward a shoulder (32) of the coil core (7). The neck portion (6) of the coil core (7) extends into the recess (29) and a rivet (39) for fastening the neck portion (6) in the recess (29) of the support (26). The recess (29) and the projection (28) are approximately equal. A method of making the electromagnetic relay is also described.

8 Claims, 1 Drawing Sheet

18
19
20
23
22
3
5
4
10
1
11
34
27
21
39
7
8
9
24
6
30
14
12
25
13
17
16
17
15
17
2

18
3
22
4
5
30
27
36
37
32
35
29
33
34
6
31
8
38
28
7
26

18
3
22
4
5
30
27
36
32
35
29
33
34
6
39
31
8
28
7
26

METHOD OF MANUFACTURING OF AN ELECTROMAGNETIC RELAY AND RELAY OBTAINED THEREBY

BACKGROUND OF THE INVENTION

The invention relates to a method of manufacturing an electromagnetic relay comprising a yoke made of a ferromagnetic material and having a wall, and a coil core made of a ferromagnetic material and having a neck portion fixedly engaged in the yoke wall, which method includes displacing the coil core axially by deforming the yoke material until a predetermined dimension necessary for compensation of tolerances, is reached.

For the foregoing relays, it is important that magnetic resistance of the magnetic circuit is as small as possible. However, the foregoing relays, especially small ones, have a resistance which is often prohibitively high because area of connection or joint between the yoke and the coil core is rather short and, in addition, during operation of the relay, it is subjected to elevated temperature and cycle loads. It is also important that the pole surface of the coil core and the abutment for the relay armature are properly positioned relative to each other to thereby reduce the resistance. To this end, in a known relay, the core is pressed into the yoke wall until a desirable dimension is achieved. The drawback of this approach consists in that for insertion of the core into the yoke wall, a relatively large displacement force is needed for the core to displace the adjacent yoke wall material in the connection region. A further drawback consists in that the coil core need be made from a hard non-deformable material so that the core would not distort. Therefore, the known relay is relatively expensive.

SUMMARY OF THE INVENTION

The object of the invention is to provide a method of manufacturing an electromagnetic relay and a relay produced by the method, that will insure that the magnetic resistance of yoke-core connection is reduced and a smaller force is required for securely mounting the coil core on the yoke wall.

These objects and others which will become more apparent hereinafter are attained in an electromagnetic relay, particularly an armature relay, comprising a ferromagnetic yoke, which has a yoke wall and a projection extending in an axial direction from an inner surface of the yoke wall, the projection being provided with a hole, and a ferromagnetic coil core, which is mountable with a neck portion engaging in the hole, so that the coil core is displaced axially a predetermined distance for a tolerance compensation.

According to the invention, the relay further comprises a support of the following kind for the coil core. This support necessarily has the projection extending from the inner surface of the yoke wall and a recess in an outer surface of the yoke wall on an opposite side from the projection on the inner surface. The projection extends toward a shoulder of the coil core and the neck portion of the coil core extends through the hole into the recess. A rivet is provided for fastening the neck portion in the recess in the support. The recess and the projection are of approximately equal size.

Because of the structure described above, a strong permanent attachment between the coil and the yoke wall can be obtained, without a press fit between the neck portion and the hole, which requires an excess force.

In other embodiments advantageously a structure having a high magnetic flux with a low magnetic resistance is provided. For example, the support can have a circular surface, whose outer diameter is about twice as large as an inner diameter of the hole.

The present invention both as to its construction so to its method of operation, together with additional objects and advantages thereof, will be best understood from the following detailed description of specific embodiments when read in connection with the accompanying drawings.

DETAILED DESCRIPTION OF THE PREFERRED EMBODIMENT

Figure 1:
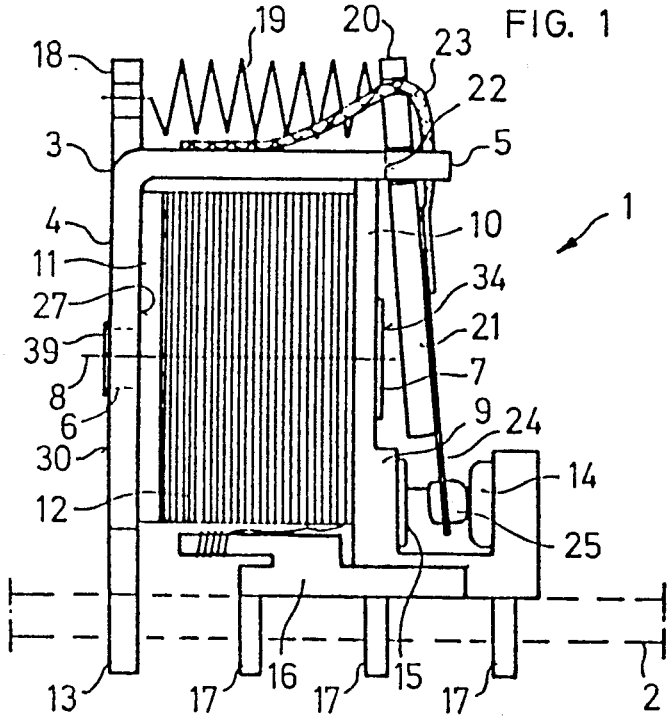
FIG. 1 shows a side view on an enlarged scale of a relay according to the present invention.

Relay 1 according to the present invention is shown in FIG. 1 as being supported on a printed board 2 that may have on upper and lower surfaces thereof strip conductors. The relay 1 includes a yoke 3 made of a ferromagnetic material and having a back wall 4 and an arm 5 extending from the back wall 4 at a right angle. A coil core 7 also made of a ferromagnetic material and having a neck portion 6 of a reduced diameter, is supported on the back wall 4 of the yoke 3. The axis 8 of the coil core 7 extends parallel to the arm 5 of the yoke 3. The core 7 carries a coil former 9 made of an insulating material and having front and rear plates 10 and 11. The coil former 9 supports a wire coil 12 located between the front and rear plates 10 and 11.

The relay 1 at the lower part thereof is provided with fastening pegs 13 extending from the back wall 4, and center pegs 17 associated with a rest contact 14, an operating contact 15, and a coil connection part 16. The center pegs 17 are received in spaced holes provided in a breadboard of the printed board 2. In an upper rear angular region, yoke 3 has a peg 18 to which a helical spring 19 is connected at one end thereof. The other end of the spring 19 is connected to an upwardly projecting leg 20 of an armature 21. The armature 21 is pivotally supported on an abutment 22 of the yoke arm 5. A metal strip 23 is supported at one end thereof on a yoke 3. The other end of the metal strip 23 contacts the armature 21. A thin contact spring blade 24 may be provided on the front surface of the armature 21. The contact spring blade 24 may carry one or more switching contacts 25 between the rest and operating contacts 14 and 15.

Figure 2:
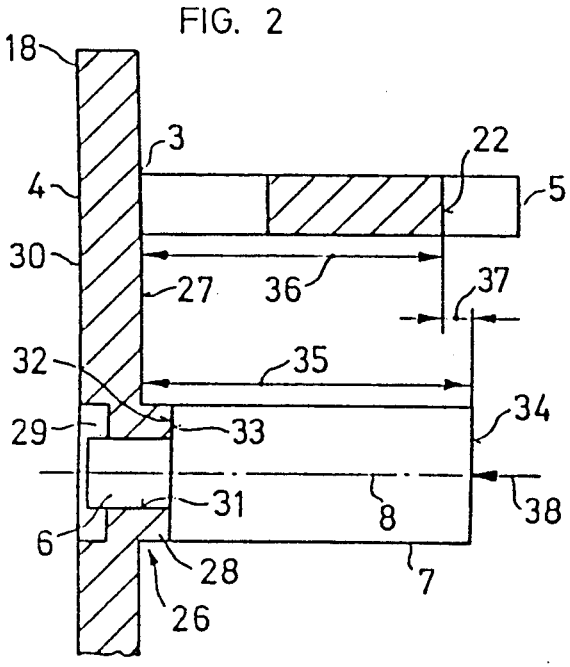
FIG. 2 shows a partial cross-sectional side view on an enlarged scale of a relay according to the present invention with a coil core inserted into a yoke but not yet secured thereto.

As shown in FIG. 2, the back wall 4 of the yoke 3 may have a support 26. The support 26 may be formed as a projection 28 extending from an inner surface 27 of the back wall 4 of the yoke 3. On an opposite outer surface 30 of the yoke back wall 4, the support 26 has a recess 29. The neck portion 6 of the coil core 7 is received in the opening 31 defined by the inner diameter of the support 26. When the core 7 is inserted into the support 26, an end surface 32 of the core 7 abuts an annular surface 33 defined by inner and outer diameters of the projection 28. The diameter of the coil core 7 and the outer diameter of the projection 28 may have advantageously substantially the same size. Just as well, the diameter of the core neck portion 6 may be equal to or smaller than the diameter of the hole 31 so that the neck portion 6, upon assembly of the relay, is received in the hole 31 without a clearance.

It may be advantageous, to so select the inner and outer diameters of the projection 28 that the width of the annular surface 33 is substantially equal to the thickness of the yoke wall 4. It is also advantageous to so select the inner and outer diameters of the projection 28 that the outer diameter of the projection 28 is approximately twice as big as the inner diameter of the projection 28 that is the diameter of the hole 21. As shown in FIG. 2, the support 26 in the yoke wall 4 can be advantageously so formed that the axial size of recess 29 in the outer surface of the yoke wall 4 and the axial length of the projection 28 extending from the inner surface 27 of the yoke wall 4 are substantially equal. To this end, the axial size of the recess 29 formed in the yoke wall 4, and/or the axial length of the projection 28 extending from the inner surface 27 of the yoke 3, may be so chosen that they are substantially equal or somewhat bigger than a half of the thickness of the yoke wall 4. As also can be seen in FIG. 2, the axial length of the neck portion 6 of the coil core 7 may be somewhat greater than the distance between the bottom of the recess 29 and the annular surface 33. Thus, the neck portion 6 may be countersunk in the recess 29 of the passage 26.

Figure 3:
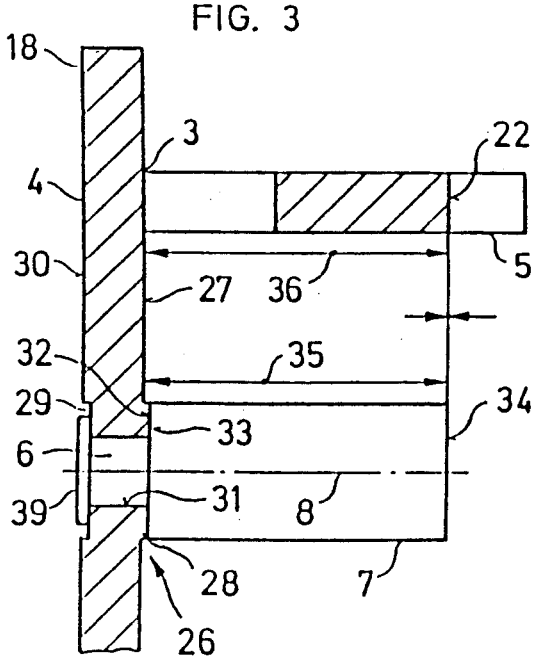
FIG. 3 shows the same view as FIG. 2 but with the coil core being secured to the yoke.

As shown in FIG. 2, a polar surface 34 at an end of the core 7, which is opposite to an end of the core 7 at which the neck portion 6 is arranged, lies in a plane which is spaced further away from the surface 27 of the yoke 3 from which the projection 28 extends, than the plane of the abutment 22. Therefore, the distance 35 between the polar surface 34 and the yoke inner surface 27 is greater than the distance 36 between the yoke inner surface 27 and the abutment 22. Thus, the polar surface 34 is spaced from the plane of the abutment 22 by a distance 37. Upon assembling of the core 7 with the yoke 3, an axial pressure force 38 acts on the polar surface 34. As a result, the end surface 32 of the core 7 is firmly pressed against the annular surface 33 of the projection 28 so that the projection 28 is compressed in the direction toward the yoke wall 4. As a result, the end surface 32 of the core 7 and the annular surface 33 of the projection 28 are approximately in the plane of the inner surface 27 of the yoke wall 4 or in a plane that is only slightly spaced from the inner surface 27, as it is shown in FIG. 3. The projection 28 is advantageously compressed to such an extent that the polar surface 34 of the core 7 is located in the plane of the abutment 22. Thereby, the distance 37 between the polar surface 34 and the abutment 22 shown in FIG. 2 is substantially eliminated and equal practically to zero. Thereby, it may be advantageously provided that the sum of the length of the core 7 between the polar surface 34 and the end surface 32 thereof, and the length of the compressed projection 28 between the inner surface 27 and core end surface 32 is equal to the distance between the inner surface 27 and the abutment 22. It is also within the scope of the invention that the projection 28 can be compressed more or less than as discussed above, so that the distance 35 between the inner surface 27 of the yoke wall 4 and the pole surface 34 of the core 7 is less or more than the distance 36 between the inner surface 27 and the abutment 22. Also, it may be advantageous to so fasten the free end of the neck portion 6 with respect to the outer surface 30 of the yoke wall 4 that at least a portion of the rivet 39 lies in the recess 29 of the passage 26.

The advantage of the method of assembling, according to the invention, of a relay and of a relay obtained thereby, consists in that a precise and a long-lasting connection of the core 7 with the yoke 3 is obtained. At that, a rather big retention surface is provided in the connection region of both parts so that a high magnetic flux is provided at a low magnetic resistance. Upon compression of the projection 28, the walls of the passage 26, due to the upsetting deformation, firmly engage the circumference of the neck portion, 6, while the end surface 32 of the core 7 firmly engages the annular surface 33 of the projection 28. Thereby the rivet 39 insures both a press fit connection and a form-locking connection so that a pressure force-locking connection of the neck portion 6 of the core 7 and the support 26 is obtained in an axial as well as a radial direction.

While the invention has been illustrated and described as embodied in a method of manufacturing an electromagnetic relay and a relay obtained by the method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a method of manufacturing an electromagnetic relay, particularly an armature relay (1), comprising a yoke (3) made of a ferromagnetic material, said yoke having a yoke wall (4) with an inner surface (27) and an outer surface (30) and also having a projection (28) extending in an axial direction from the inner surface (27) of the yoke wall (4), the projection (28) being provided with a hole (31); and also comprising a ferromagnetic coil core (7), said coil core having a shoulder (32) and a neck portion (6) and being mountable on the yoke wall (4) with the neck portion (6) engaging in the hole (31), so that the coil core (7) is displaced axially a predetermined distance for a tolerance compensation, the improvement comprising the steps of providing a support (26) on the yoke wall (4), said support including the projection (28) and a recess (29) in the outer surface (30) of the yoke wall (4) on an opposite side from the projection on the inner surface (27), compressing the projection (28) toward the inner surface of the yoke wall by the shoulder (32) of the coil core (7), extending the neck portion (6) of the coil core (7) into the recess (29) and fastening the neck portion (6) by a rivet (39) in the recess (29) of the support (26).

2. The improvement as defined in claim 1, wherein the recess (29) of the support (26) has a depth not less than half of a thickness of the yoke wall (4).

3. In an electromagnetic relay, particularly an armature relay (1), comprising a yoke (3) made of a ferromagnetic material, said yoke having a yoke wall (4) with an inner surface (27) and an outer surface (30) and said yoke wall having a projection (28) extending in an axial direction from the inner surface (27) of the yoke wall (4), the projection (28) being provided with a hole (31) having an inner diameter; and a ferromagnetic coil core (7), said coil core having a shoulder (32) and a neck portion (6) and being mountable with the neck portion (6) engaging in the hole (31), so that the coil core (7) is displaced axially a predetermined distance for a tolerance compensation, the improvement comprising a support (26) on the yoke wall (4) for the coil core (7), said support (26) including the projection (28) and being provided with a recess (29) in the outer surface (30) of the yoke wall (4) on an opposite side of the yoke wall (4) from the projection on the inner surface (27), the projection (28) extending from the inner surface of the yoke wall toward the shoulder (32) of the coil core (7), the neck portion (6) of the coil core (7) extending through the hole (31) into the recess (29) and a rivet (39) for fastening the neck portion (6) in the recess (29) of the support (26), wherein the recess (29) and the projection (28) are of an approximately equal size.

4. The improvement as defined in claim 3, wherein the support (26) is provided with a circular surface (33) having an outer diameter, said outer diameter being about twice as large as the inner diameter of the hole (31).

5. The improvement as defined in claim 4, wherein the coil core has a coil core outer diameter, and the outer diameter of the support (26) and the coil core outer diameter are substantially equal.

6. The improvement as defined in claim 4, wherein a difference between the inner diameter of the hole and the outer diameter of the support (26) is approximately equal to twice a thickness of the yoke wall (4).

7. The improvement as defined in claim 3, wherein the shoulder (32) of the coil core (7) pressed against the projection (28) is approximately in or adjacent the inner surface (27) of the yoke wall (4).

8. The improvement as defined in claim 3, further comprising an arm (5) extending approximately at right angles to the yoke wall (4) and an abutment (22) on the yoke wall for the arm, and wherein the coil core has a free end opposite the shoulder (32), and wherein a length of the coil core (7) from the free end (34) to the shoulder surface (32) plus a length of the projection (28) from the shoulder (32) to the inner surface (27) of the yoke wall (4) is equal to a distance between the inner surface (27) of the yoke wall (4) and the abutment (22) of the arm (5).

* * * * *